United States Patent [19]

Eguchi et al.

[11] Patent Number: 4,690,082

[45] Date of Patent: Sep. 1, 1987

[54] DEVICE FOR REGULATING UPPER THREAD TENSION OF A SEWING MACHINE

[75] Inventors: Yasukata Eguchi; Kazumasa Hara, both of Tokyo; Michio Hisatake, Fujino, all of Japan

[73] Assignee: Janome Sewing Machine Co Ltd., Tokyo, Japan

[21] Appl. No.: 796,392

[22] Filed: Nov. 7, 1985

[30] Foreign Application Priority Data

Nov. 9, 1984 [JP] Japan ..... 59-234900

[51] Int. Cl.[4] ..... D05B 47/04

[52] U.S. Cl. ..... 112/254

[58] Field of Search ..... 112/254, 59, 97, 255; 242/150 R

[56] References Cited

U.S. PATENT DOCUMENTS 3,722,439 3/1973 Newman ..... 112/254

4,221,180 9/1980 Coulombe ..... 112/254

FOREIGN PATENT DOCUMENTS 60-83696 5/1985 Japan ..... 112/254

*Primary Examiner*—Werner H. Schroeder

*Assistant Examiner*—Andrew M. Falik

*Attorney, Agent, or Firm*—Michael J. Striker

[57] ABSTRACT

A device for regulating upper thread tension in a sewing machine having an upper thread tension device with two discs receiving an upper thread therebetween, a spring pressing the discs one against the other, a presser body positioned between the spring and the discs, and a manually operated dial for actuating the presser body, the regulating device having an indicator for indicating a thread tension of a proper value and operatively connectable to the dial and movable thereby, in which a relation between a moving amount of the presser body and a moving amount of the indicator is regulated and a pressure of the thread tension is adjusted to the movement of the thread tension indicator.

7 Claims, 14 Drawing Figures

FIG_5
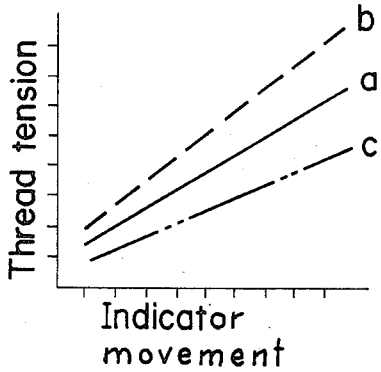
FIG_6
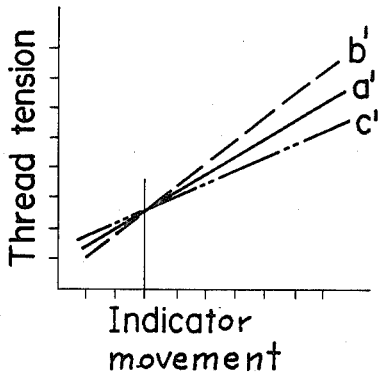
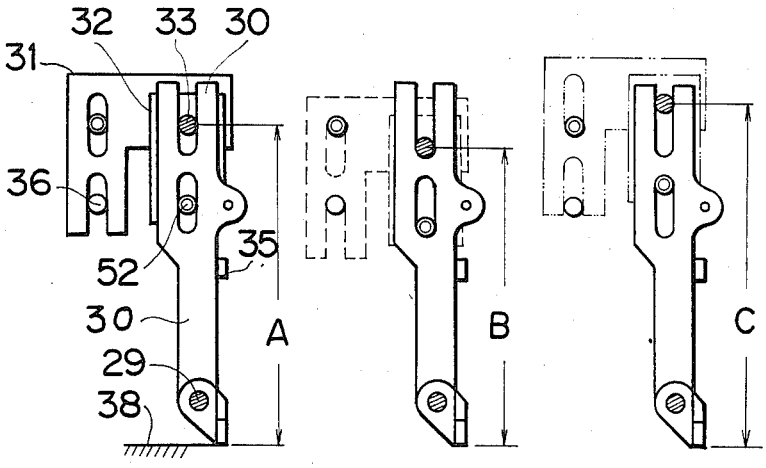
FIG_9A FIG_9B FIG_9C

FIG_10
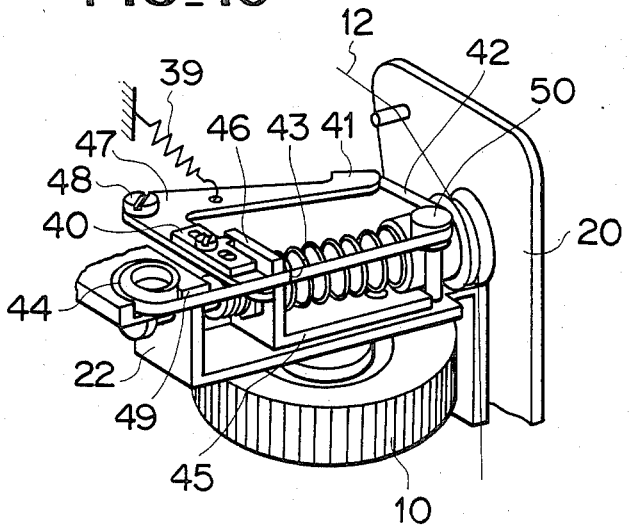
FIG_11
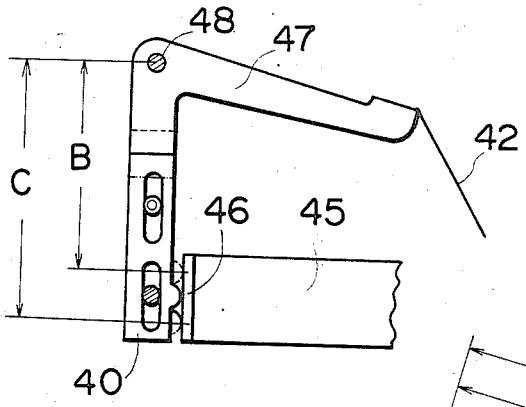
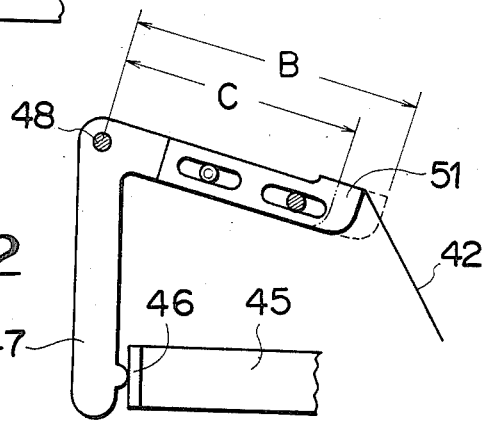
FIG_12

DEVICE FOR REGULATING UPPER THREAD TENSION OF A SEWING MACHINE

BACKGROUND OF THE INVENTION

The invention relates to an upper thread tension adjusting device for a sewing machine.

It is known that the selection or designation of the type of thread to be used and/or the type of fabric to be sewn will indicate the degree of thread tension to be subsequently adjusted as taught in U.S. Pat. No. 4,236,467 of the same assignee.

Until now, as shown in FIG. 6, thread tensions (a', b', c') of the sewing machines may be identical at one of the graduations of a display part, but may be different at the other graduations due to the possible discrepancies and deviations in precision of elements constituting the upper thread adjusting devices of the sewing machine. It has therefore been practically difficult to show the upper thread tension by the graduations.

The upper thread tension device of the sewing machine has the relationship between the thread tension and the indication of the strength of a spring provided for the thread tension as shown in FIG. 5. Each of the thread tension devices has individually different characteristics.

Conventionally, individual differences are regulated, as shown in FIG. 6, by handling an upper thread tension at a certain point.

SUMMARY OF THE INVENTION

It is an object of the present invention to adjust the thread tension in reference to the type of a thread to be used and the type of a fabric to be sewn.

As seen with reference to FIGS. 7 and 8, the type of the thread, which, for example, is thick, normal or thin, and/or the type of a fabric which, for example, is thick, normal or thin are selected by optionally pressing the switches 1–3 and 4–7 respectively.

A computer is operated in response to the pressing operation of the switches to light one or two of the light emitting diodes 9 arranged in a line to form graduations in the display in FIG. 8, and then the manually operated dial 10 is operated to move the indicator 11 into alignment with the active diode which is a designated graduation.

It is therefore an object of the invention to provide the most desirable thread tension in a position where the activated diode and the indicator 11 is aligned as shown in FIG. 8 depending upon a stitching condition especially including the type of thread to be used and the type of a fabric to be sewn.

It is an additional object of the invention to provide an upper thread tension adjusting device of a sewing machine and more particularly a device which may be properly adjustable regardless of the possible discrepancies and deviations in precision of elements and including a constant pressure spring constituting the upper thread tension adjusting device. The device of the invention is simple in structure and effecitive in operation to uniform the upper thread tension adjustability of the sewing machines which may be produced in large quantity.

The present invention has been provided to eliminate the defects and disadvantages of the prior art. It is therefore an object of the invention to provide an indicator which is operatively connected to a pressure spring and may be movable therewith, the movement of which is proportionate to the pressure of the pressure spring applied to the upper thread.

Further it is an object of the invention to make adjustable the movement of the indicator in proportion to the pressure of a pressure spring applied to the upper thread, to thereby individually set the upper thread tension adjusting devices of the sewing machines which may be produced in a large quantity, such that the sewing machines may have the upper thread tension devices which may be constantly adjustable in reference to the graduations of a display part just as shown in FIGS. 5 and 9.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 5 is an explanatory view showing the relatioship between upper thread tensions and movements of indicators as adjusted according to the invention;

FIG. 6 is an explanatory view showing the relationship between upper thread tensions and movements of indicators according to the prior art;

FIGS. 9A, 9B and 9C show plan views of an indicator as positionally adjusted to change the movement rate thereof;

FIG. 10 is a perspective view of a thread tension adjusting device of a second embodiment of the invention;

FIG. 11 is a plan view of an indicator positionally adjusted in one way to change the movement rate thereof;

FIG. 12 is a plan view of an indicator positionally adjusted in another way to change the movement rate thereof.

DETAILED DESCRIPTION OF PREFERRED EMBODIMENTS

Figure 7:
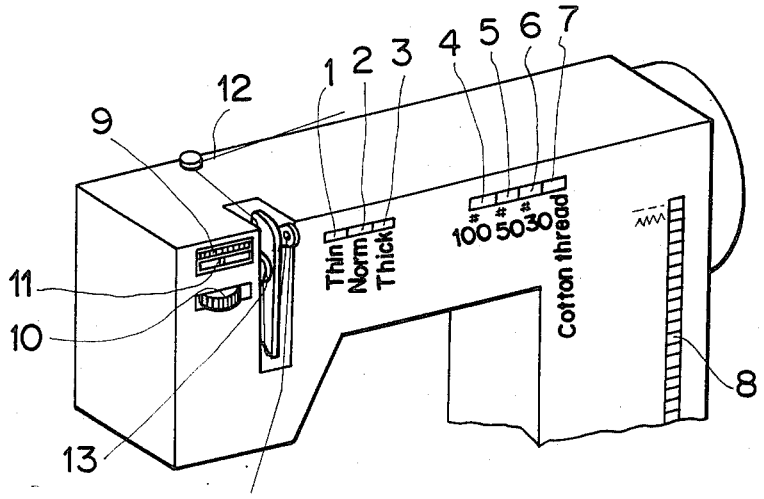
FIG. 7 is a perspective view of the sewing machine incorporated with the thread tension adjusting device of the invention.
Figure 8:
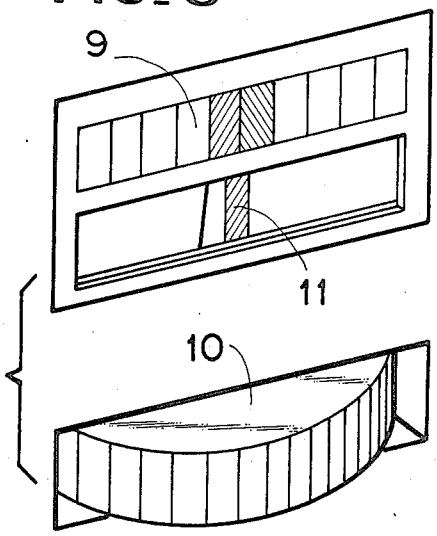
FIG. 8 shows enlarged views of the indicating parts of the device.

FIG. 7 shows a sewing machine incorporated with an upper thread adjusting device of the invention in which numerals 1 to 3 designate conditioning buttons for selection in dependence upon fabric thicknesses, numerals 4 to 7 are conditioning buttons for selection in dependence upon thread types, numeral 8 denotes a group of pattern selection buttons, numeral 10 designates a dial of a thread tension device, numeral 11 is an indicating needle which is moved linearly and laterally by rotation of the dial 10, and numeral 9 denotes scales of a plurality of luminous diodes, arranged linearly in response to the indicating needle moved by the indication of a microcomputer (not shown) connecting electrical signals from buttons for selection a fabric thickness, thread type and stitching patterns.

FIGS. 1 to 4 show the first embodiment of the invention. A thread tension shaft 23 is secured by a disc screw 21 at its one end to a base 20 supported to a machine frame, and is mounted at its other end to a support plate 22 which is rigidly secured to the base 20. The thread tension shaft 23 has mounted thereon thread tension discs 13, 13*a* for holding an upper thread 12, and a presser body 16 for uniformly pressing a thread tension disc.

Numeral 19 denotes a regulating or adjusting bolt having a brim or edge contacting the thread tension spring 15 and mounted on the thread tension shaft 23.

The support plate 22 is secured with a pin 25 at a center thereof between the thread tension shaft 23 and the base 20, and is provided with a dial 10 rotated about the pin 25. A thrust is formed by a brimmed screw 26 fitted in a screw hole formed in the pin 25.

Numeral 18 is a middle plate which holds a pin 14 engaged in a cam groove 17 formed in the dial 10 and extending through an oblong hole formed in the support plate 22. The middle plate 18 is defined with a projection 35 meshing with the adjusting bolt 19; projection 35 extends transversely of the thread tension shaft 23 and engages an indicating lever 30 for indicating the thread tension.

Figure 3:
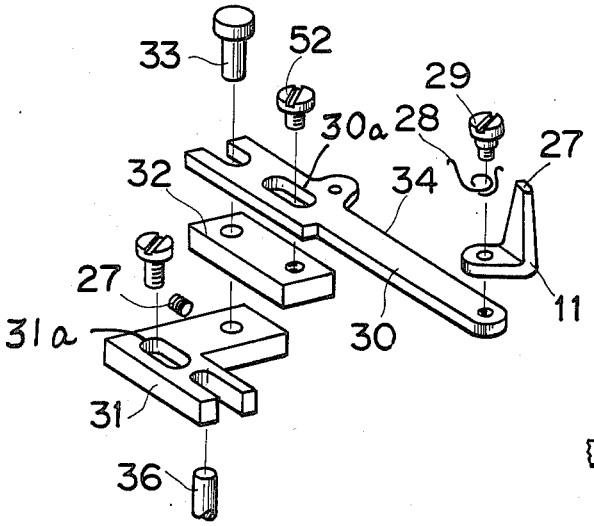
FIG. 3 is an exploded perspective views of a regulating part.
Figure 4:
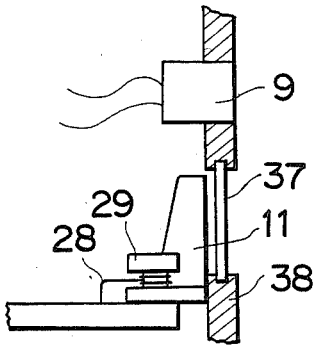
FIG. 4 is a cross sectional view of an indicator.

An indicating needle 27 shown in FIG. 3 is rotated clockwise by a spring 28 about a stepped screw 29 on the indicating lever 30. A bed plate 31 is formed with an oblong hole 31*a* and an oblong groove 31*b* in correspondence with a pin 36 and a screw for moving vertically. The indicating lever 30 is also formed with an oblong hole 30*a* and is movable with respect to a regulating or adjusting plate 32, and is as a whole movably attached to the bed plate 31 by means of a pin 33. The pin 33 positions the regulating plate 32 and the indicating lever 30 in a thrust direction between the brim or edge thereof and the regulating plate 31, and is fixed by a stopper screw 27*a* in the bed plate 31. The indicating lever 30 is biased at its middle part 34 toward the projection 35 formed at the upper part of the middle plate 18 by means of a spring 53 held at its one end to the machine frame. As shown in FIG. 4, a frame 38 holding a transparent cover 37 is positioned at a distance from the indicator 11 which is moved in parallel to the frame 38 by the spring 28.

The thread tension is controlled by rotating the dial 10, and the middle plate 18 is guided by the pin 14 within the cam groove 17 and the adjusting bolt 19, and performs linear movement. The pressure of the thread tension spring 15 is changed between the brim or edge of the adjusting bolt 19 and the presser body 16, so that the holding pressure between the thread tension discs 13 and 13*a* is changed accordingly. With respect to the indication of the thread tension at this time, the indicating lever 30 is guided by the projection 35 of the middle plate 18 and is rotated about the pin 33, so that the indicator 11 is guided with respect to the frame 38 and makes linear movement.

The thread tension is controlled to adjust it to a setting value by rotating dial 10 to regulate the adjustment bolt 19 and change the compression amount of the thread tension spring 15 and then securing the nut 24.

Figure 1:
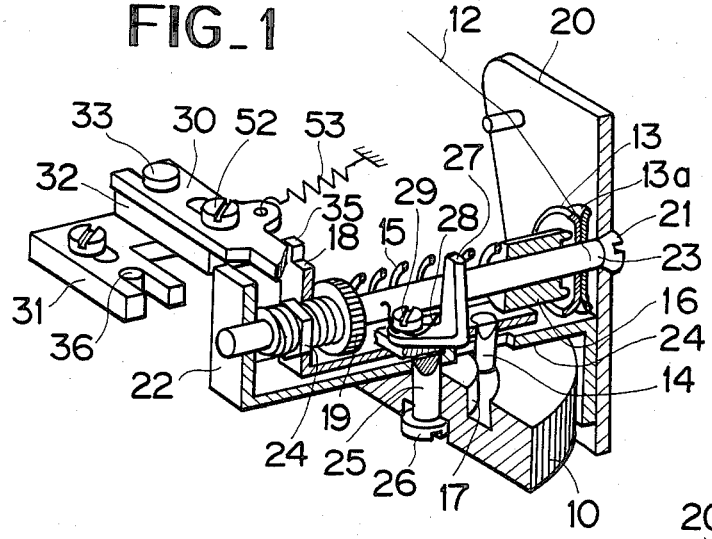
FIG. 1 is a perspective view of a thread tension adjusting device of a first embodiment of the invention.
Figure 2:
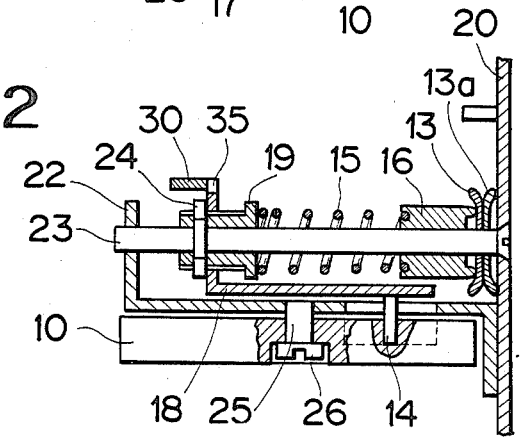
FIG. 2 is a cross section view taken along line II—II of FIG. 1.

The adjustment of the gradient of the thread tension, which is one of the characteristics of the invention, is carried out by loosening the stopper screws of the indicating lever 30 and the bed plate 31, sliding them within the oblong grooves 30*a*, 31*a*, and changing the distance between the contact 34 of the indicating lever 30 and the pin 33. When the bed plate 31 comes close to the middle plate 18 as shown in FIG. 1 and FIG. 9-B, the distance between the pin 33 and the contact 34 of the lever 30 for the middle plate 18 is shortened, and the rotation angle of the indicating lever 30 is increased since the amount of movement of the middle plate 18 is fixed due to the groove cam 17, and the movement of the indicator 11 is increased. Therefore, when the amount of movement of the indicator 11 is changed along the scale within a certain range, the movement of the middle plate 18 is reduced more than before the adjustment by loosening, and the maximum condition of the gradient of the thread tension shown by "b" in FIG. 5 approaches a determined amount "a". The regulating plate 32 is provided to avoid a case in which the distance between the pin 33 and the frame 38 is varied by the movement of the bed plate 31 so that the indicator 11 is insufficiently rotated. An adjustment is made between the regulating plate 32 and indicating lever by loosening a screw 52 of the indicating lever 30.

When the bed plate 31 is moved away from the middle plate 18, a condition will be made as shown in FIG. 9-C, and the rotation angle of the indicating lever is made small so that the moving amount of the indicator 11 is reduced. Therefore, if the moving amount of the indicator 11 is changed along the scale within a certain range, the moving amount of the middle plate 18 is increased more than pre-adjustment, and the minimum condition of the gradient of thread tension shown by "c" in FIG. 5 approaches the determined amount "a".

When the bed plate 31 is shifted in one direction until the pivot pin 33 is positioned at the inner end of the bifurcated part of the lever 30 as shown in FIG. 9B, the distance B between the pivot pin 33 and the indicator 11 is at a minimum. Therefore, the angular movement of the indicator 11 is maximum in proportion to the pressure of the tension spring 15 applied to the upper thread as shown by a broken line (b) in FIG. 5, which depends upon the rotation amount of the operating dial 10. When the bed plate 31 is shifted in the opposite direction until the pivot pin 33 is positioned at the outer end of the bifurcated part of the lever 30 as shown in FIG. 9-C, the distance C between the pivot pin 33 and the indicator 11 becomes the maximum, and therefore the angular movement of the indicator 11 is minimum in proportion to the pressure of the tension spring 15 applied to the upper thread as shown by a two-dotted line (c) in FIG. 5. When the bed plate 31 is moved until the pivot pin 33 is positioned at the center of the bifurcated part of the lever 30 as shown in FIG. 9A, the distance A between the pivot pin 33 and the indicator 11 is medium in proportion to the pressure of the tension spring 15 applied to the upper thread, and therefore the angular movement of the indicator 11 is medium as compared with those of FIGS. 9B and 9C as shown by the solid line (a) in FIG. 5. Thus it is possible to variably adjust the position of the pivot pin 33 within the range of the bifurcated part of the lever 30 so as to provide as many relations between the thread tensions and the movements of the indicator 11 as shown by the lines (a, b, c) in FIG. 5.

Such relations may be used to overcome the precision deviations and discrepancies of the elements constituting the upper thread tension device of mass-produced sewing machines such that the thread tension devices of individual sewing machines may be operated to uniformly adjust the upper thread tension in reference to the graduations in the display along which the indicator 11 is moved.

The second embodiment of the invention is as shown in FIG. 10. A thread tension mechanism is the same as in the first embodiment, but differs in extension of an upright part 46 of a middle plate 45 in a transverse direction relative to a thread tension shaft 23, and in a thread tension indicating mechanism. An indicating lever 47 is rotatable about a pin 48 fixed to the machine frame, and it has, at its end, a regulating or adjusting piece 40 which contacts the upright part 46 of the middle plate 45 and is formed with an oblong hole for allowing parallel movement relative to the upright part. An end of the spring 39 is secured to lever 47 and the other end of this spring is secured to the machine frame, so that the regulating plate 40 is in contact with the upright part 46 of the middle plate 45 due to the biasing force of the spring 39. The other end of the indicating lever 47 is used for indicating the thread tension. The end 41 of the lever 47 is attached with an elastic tape 42 marked with an indicating line 43, while the other end is formed as a coil engaged in a groove 44 defined in a support plate 22 integral with the base 20. The tape 42 is guided by a guide face 49 and an outer circumference of a roller 50 to a transparent window furnished in the machine frame.

The thread tension is regulated as in the first embodiment by rotating the dial 10 and moving the middle plate 45 in parallel together with the thread tension shaft 23 so as to change the holding pressure of the upper thread 12, rotating the indicating lever 47 about the pin 48 via the regulating plate 40, moving the tape 42, and changing the indicating line 43.

The gradient of the thread tension is regulated or adjusted by moving back and forth the regulating plate 40 mounted on the indicating lever 47, and controlling the distance between the pin 48 and the regulating plate 40. That is, if the regulating plate 40 is closer to the pin as shown in FIG. 11 by distance B, the rotation angle of the lever 47 for the movement of the middle plate 45 is widened so that the indicating line 43 marked on the tape 42 is moved largely. Therefore, if the moving amount of the indicating line 43 is moved along the scale within a certain range, the moving amount of the middle plate 45 is reduced more than the preadjustment value and the high condition of the gradient of the thread tension shown by "b" in FIG. 5 approaches the determined value "a". If the regulating plate 40 is remoter from the pin as shown in FIG. 11, by distance C, the rotation angle of the lever 47 is reduced and the movement of the indicating line 43 is made small. Therefore, if the movement of the indicating line 43 is determined along the scale within a certain range, the moving amount of the middle plate 45 is increased more than the pre-adjustment value and the low condition of the gradient of the thread tension shown by "c" in FIG. 5 approaches the determined value "a".

The third embodiment of the invention is shown in FIG. 12, where a part of the tape 42 is attached to a regulating plate 51, while the detecting side of the tape is not changed, although in the second embodiment, the lever 47 is provided with the regulating plate 40 for regulating the contact of the regulating plate 40 which is the detecting part of the thread tension part.

With respect to the adjustment of the gradient of the thread tension, as shown in FIG. 12 by distance B, the distance from the pin 48 is made large within oblong grooves, so that the regulating plate 51 makes a large movement for the movement of the middle plate 45, and the indicating line 43 makes also a large movement. Therefore, reversely if the indicating line 43 is moved along the scale within a certain range, the moving amount of the middle plate 45 is reduced more than the preadjustment value and the high condition of the gradient of the thread tension shown by "b" in FIG. 5 approaches the determined value "a".

If the regulating plate 51 is closer to the pin as shown in FIG. 12 by distance C to shorten the distance from the pin 48, the movement of the regulating plate 51 is reduced with respect to the movement of the middle plate 45, and the indicating line 43 makes a small movement. Therefore, if the indicating line 43 is moved along the scale within a certain range, the moving amount of the middle plate 45 is increased more than the preadjustment value, and the low condition of the gradient of the thread tension shown by "c" in FIG. 5 approaches the determined value "a".

What is claimed is:

1. A device for regulating upper thread tension in a sewing machine having an upper thread tension device with two discs receiving an upper thread therebetween, a spring pressing the discs one against the other, a presser body positioned between said spring and said discs, and a manually operated dial for actuating said presser body, the regulating device comprising an indicator for indicating a thread tension of a proper value and operatively connected to said dial and movable thereby, and a regulating means for regulating a relation between a moving amount of said presser body and a moving amount of said indicator and adjusting a pressure of a thread tension to the movement of the thread tension indicator.

2. A device as claim in claim 1, wherein said regulating means includes an element which increases the moving amount of said indicator.

3. A device as claimed in claim 1, wherein said regulating means includes an element which decreases the moving amount of said indicator.

4. A device as claimed in claim 1, wherein said indicator is operatively connectable with the spring and movable therewith in proportion to the pressure of the thread tension.

5. A device as claimed in claim 4, wherein said regulating means includes means for changing a rate of movement of said indicator so as to change said proportion to said pressure of said thread tension.

6. A device as claimed in claim 5, wherein said regulating means includes a pivotable element, said element pivoting in response to a movement of said indicator so as to be able to exert a pressure against the spring.

7. A device as defined in claim 6, wherein said regulating means further includes a member about which said element is pivotable, said member being movable to change said rate of movement of said indicator when said element pivots.

* * * * *